US006710534B2

(12) United States Patent
Patterson et al.

(10) Patent No.: US 6,710,534 B2
(45) **Date of Patent: *Mar. 23, 2004**

(54) TRAVELING WAVE TUBE HAVING MULTILAYER CARBON-BASED EMITTER

(75) Inventors: Donald E. Patterson, Pearland, TX (US); Keith D. Jamison, Austin, TX (US)

(73) Assignee: Extreme Devices, Inc., Austin, TX (US)

( * ) Notice: Subject to any disclaimer, the term of this patent is extended or adjusted under 35 U.S.C. 154(b) by 218 days.

This patent is subject to a terminal disclaimer.

(21) Appl. No.: 09/771,862

(22) Filed: Jan. 29, 2001

(65) Prior Publication Data

US 2002/0011774 A1 Jan. 31, 2002

Related U.S. Application Data

(62) Division of application No. 09/169,909, filed on Oct. 12, 1998, now Pat. No. 6,181,055.

(51) Int. Cl.[7] ..... H01J 29/46
(52) U.S. Cl. ..... 313/446; 313/495; 313/336
(58) Field of Search ..... 313/446, 310, 313/311, 412, 309, 495, 336, 351, 497, 500; 427/78; 340/778

(56) References Cited

U.S. PATENT DOCUMENTS

| | | | | |
|---|---|---|---|---|
| 3,798,478 A | | 3/1974 | Say | |
| 3,943,281 A | | 3/1976 | Keller et al. | |
| 4,091,332 A | | 5/1978 | Crandall | |
| 4,361,781 A | | 11/1982 | Depp et al. | |
| 4,616,160 A | | 10/1986 | Holtey et al. | |
| 4,633,142 A | | 12/1986 | Marshall | |
| 4,633,244 A | | 12/1986 | Holtey et al. | |
| 4,818,914 A | * | 4/1989 | Brodie | 313/336 |
| 4,954,901 A | | 9/1990 | Okada et al. | |
| 5,350,978 A | | 9/1994 | Chen | |
| 5,382,883 A | | 1/1995 | Chen et al. | |
| 5,389,855 A | | 2/1995 | Chen | |
| 5,439,753 A | | 8/1995 | Rogers | |

(List continued on next page.)

FOREIGN PATENT DOCUMENTS

| | | |
|---|---|---|
| EP | 0 959 148 A2 | 11/1999 |
| EP | 0 967 844 A1 | 12/1999 |
| WO | WO00/10190 A2 | 2/2000 |

OTHER PUBLICATIONS

Patent application S/N 09/169,908 filed Oct. 12, 1998.
Patent application S/N 09/493,379 filed Jan. 28, 2000.

(List continued on next page.)

*Primary Examiner*—Kenneth Berck
(74) *Attorney, Agent, or Firm*—Baker Botts L.L.P.

(57) ABSTRACT

An electron field emission device is provided by placing a substrate in a reactor, heating the substrate and supplying a mixture of hydrogen and a carbon-containing gas at a concentration of about 8 to 13 percent to the reactor while supplying energy to the mixture of gases near the substrate for a time to grow a first layer of carbon-based material to a thickness greater than about 0.5 micrometers, subsequently reducing the concentration of the carbon-containing gas and continuing to grow a second layer of carbon-based material, the second layer being much thicker than the first layer. The substrate is subsequently removed from the first layer and an electrode is applied to the second layer. The surface of the substrate may be patterned before growth of the first layer to produce a patterned surface on the field emission device. The device is free-standing and can be used as a cold cathode in a variety of electronic devices such as cathode ray tubes, amplifiers and traveling wave tubes.

24 Claims, 4 Drawing Sheets

U.S. PATENT DOCUMENTS 5,483,128 A 1/1996 Chen
5,543,680 A 8/1996 Tomihari
5,557,334 A 9/1996 Legate
5,557,344 A 9/1996 Chen
5,585,691 A 12/1996 Washburn
5,689,158 A 11/1997 Chen
5,869,924 A 2/1999 Kim
5,916,005 A 6/1999 Baik et al.
5,965,977 A 10/1999 Makishima
6,181,055 B1 1/2001 Patterson et al.
6,239,547 B1 * 5/2001 Uemura et al. ..... 313/495
6,458,516 B1 * 10/2002 Ye et al. ..... 430/317

OTHER PUBLICATIONS

Patent application S/N 09/534,374 filed Mar. 24, 2000.
Patent applcation S/N 09/771,861 filed Jan. 29, 2001.
http://www.pctechguide.com/06crtmon.htm (Sep. 13, 2000).
Chapter 5.4 "Distortion Correction Circuits"; Electron Optics and Deflection, pp. 5–39–5–45.

* cited by examiner

TRAVELING WAVE TUBE HAVING MULTILAYER CARBON-BASED EMITTER

This application is a division of Ser. No. 09/169,909, filed Oct. 12, 1998.

The U.S. government has a paid-up license in this invention and the right in limited circumstances to require the patent owner to license others on reasonable terms as provided for by the terms of Contract No. F29601-97-C-0117 award by the Department of the Air Force.

BACKGROUND OF THE INVENTION

1. Field of the Invention

The present invention relates generally to traveling wave tubes. More particularly, a traveling wave tube having an electron gun using a multilayer carbon-based field emitting cathode is provided.

2. Description of Related Art

There are two basic geometries of field emission electron devices. The first geometry uses arrays of electron emitting tips. These devices are fabricated using complex photolithographic techniques to form emitting tips that are typically one to several micrometers in height and that have an extremely small radius of curvature. The tips are commonly composed of silicon, molybdenum, tungsten, and/or other refractory metals. Prior art further suggests that microtips microtips can be fabricated from diamond of a specific crystal orientation or that non-carbon microtips can be coated with diamond or a diamond-like carbon to enhance their performance. (U.S. Pat. No. 5,199,918) Also, a class of microtips based on the fabrication of thin wires or whiskers of various materials, including carbon has been described ("Field Emission from Nanotube Bundle Emitters at Low Fields," Q. Wang et al, *App. Phys. Lett.* 70, [24], pp. 3308 (1997)).

The second prior art method of fabricating a field emission device is based upon a low or negative electron affinity surface usually composed of diamond and/or diamond-like carbon (U.S. Pat. No. 5,341,063; U.S. Pat. No. 5,602,439). These devices may be formed into tips or they may be flat. Other wide bandgap materials (mainly Group III nitrides) have also been suggested as field emission devices due to their negative electron affinity properties.

In the first method, complex lithographic and/or other fabrication techniques are needed to fabricate the tips. Additionally, tips made from non-diamond materials have short functional lifetimes due to resistive heating of the tips and poisoning of the tips due to back-sputtering from the anode. Diamond-based microtips solve those two problems to some degree but typically require many negative electron affinity surfaces in order to function properly.

The second method requires a low or negative electron affinity surface for the devices to work. Additionally, the prior art suggests that an improved diamond or diamond-like emitter can be fabricated by allowing for screw dislocations or other defects in the carbon lattice. (U.S. Pat. No. 5,619,092). Diamond-based materials having current densities of 10 A/cm$^2$ have recently been described. (T. Habermann, *J. Vac. Sci. Tech.* B16, p. 693 (1998)). These devices are fabricated on and remain on a substrate.

A very recent paper describes gated and ungated diamond microtips. (D. E. Patterson et al, *Mat. Res. Soc. Symp. Proc.* 509 (1998)). Some ungated emitters were reported to allow electrical current of 7.5 microamps per tip. The process variables used to form the emitters were not discussed. If tips could be formed at a density of $2.5\times10^7$ tips/cm$^2$, it was calculated that the current density could be as high as 175 A/cm$^2$, assuming that all the tips emit and that they emit uniformly.

Different characteristics of field emitters are required for different devices. For some devices, such as flat panel displays, sensors and high-frequency devices, emission at low electric fields is particularly desirable to minimize power requirements. For other devices, higher threshold electric fields for emission are tolerable, but high currents are required. High currents are particularly needed for some applications of electron guns, in amplifiers and in some power supplies, such as magnetrons and klystrons.

Accordingly, a need exists for an improved carbon-based electron emitter that does not involve the fabrication of complex, micrometer-sized (or smaller) structures with tips or structures that require certain crystallographic orientations or specific defects in order to function properly. Additionally, these emitters should provide high levels of emission current with moderate electric fields. Preferably, the emitters should have a thickness sufficient for the emitter material to have mechanical strength in the absence of a substrate, making free-standing electron sources that are suitable for use in a variety of electronic apparatus, including traveling wave tubes.

SUMMARY OF THE INVENTION

In accordance with the present invention, a high current density carbon-based electron emitter is formed by chemical or physical vapor deposition of carbon to form a bulk structure having two layers of carbon-based material. The bulk material or body grown in this manner is believed to provide a high thermal conductivity matrix surrounding conductive carbon channels, so that the resistive heating in the conductive channels, even at high currents, can be dissipated from the channels. Electrons are ultimately emitted from the carbon surface by means of field emission from the conductive channels. In addition, the emitting layer is in direct contact with a thicker layer having very high thermal conductivity, so that heat can be transferred from the emitting layer at a rate to avoid excessive temperature and failure of the emitting layer.

The carbon-based body is grown by placing a substrate in a reactor, lowering the pressure in the reactor and supplying a mixture of gases that includes hydrogen and a carbon-containing gas such as methane at a concentration from 8 to 13 percent to the reactor. High energy is supplied to the gases near the substrate. The energy may be supplied by several methods, such as a microwave or RF plasma. The substrate is brought to a selected range of temperatures via active heating or cooling of the substrate stage within the reactor. After a layer has grown to a thickness of a few micrometers the concentration of methane is decreased and a second, much thicker layer is grown. Then the substrate is removed, leaving a stand-alone body of carbon-based material having two layers. Each layer has a preferred range of electrical resistivity. An electrode is placed on the surface of the thicker layer. Electron emission is stable with high current density from the surface of the thinner layer. This surface may be flat or may be structured. A structured surface on the carbon-based body is achieved by structuring the surface of the substrate before the emission layer is grown.

Devices based on high current density electron emission from the carbon-based body are provided. These include electron guns and cathode ray tubes containing the electron guns, amplifiers and traveling wave tubes.

BRIEF DESCRIPTION OF THE DRAWINGS

The foregoing and other objects and advantages of the invention will be apparent from the following written description and from the accompanying drawings in which like numerals indicate like parts.

DESCRIPTION OF THE PREFERRED EMBODIMENTS

For electrons in the conduction band of a material to escape into a vacuum, an energy known as the work function, $\phi$, must be supplied to the electrons to allow them to achieve an energy equal to the vacuum energy level. This energy is commonly supplied by heating the material, leading to what is known as thermionic emission. For the present invention, a quantum mechanics effect known as field emission, which allows electrons to tunnel through the potential barrier into a vacuum, is employed. Lowering of the potential barrier is achieved by applying a strong external electric field to the surface of the solid, as more fully explained in our concurrently filed patent application titled "Carbon-Based Field Emission Electron Device for High Current Density Applications." This method is only practical to field strengths of a few hundreds of volts per micrometer for present devices. An alternative method for decreasing the effect of the potential barrier is to provide for sub-micrometer-sized sharp structures, i.e., microtips that enhance the electric field strength at the microtips. Methods described in the prior art use fabricated microtips or whiskers to achieve this outcome.

The present invention uses a far less complex geometry to achieve sub-micrometer-sized features in a material—channels of conductive carbon-based material in a matrix of non-conductive carbon-based material. In addition, two layers of material having these channels are supplied, the two layers having different properties of electrical and thermal conductivity. Surprisingly, the material of this invention achieves emission of electrons at high levels of current density.

Figure 1A:
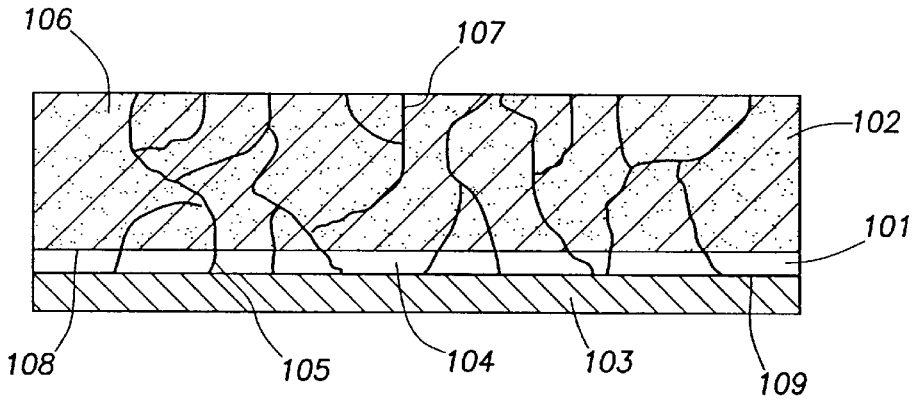
FIGS. 1A and 1B show schematic depictions of a two-layer high current carbon-based electron emitter with electrically conductive channels in an insulating, high thermal conductivity carbon structure as formed on a flat substrate (A) and after the substrate is removed and a surface has been covered with an ohmic contact (B).

FIG. 1A illustrates a carbon-based bulk material having two layers 101 and 102 on substrate 103. Carbon-based material is deposited on substrate 103 by chemical vapor deposition (CVD) or by physical vapor deposition (PVD) techniques. The carbon-based material in each layer is composed of at least 95% carbon atoms with the remainder of the material being comprised of atoms of other elements present in the deposition system. Typical species being present in the material besides carbon include, but are not limited to, hydrogen, nitrogen, and oxygen. Deposition techniques that can be used for the formation of the carbon material include, but are not limited to, microwave CVD, hot-filament CVD, DC plasma arc deposition, flame deposition, cathodic arc deposition, thermal decomposition, and magnetron sputtering. The present invention provides carbon channels 105 and 107 in each layer, the channels having a diameter less than 1 micrometer, in matrix material 104 and 106 of each layer. The channels were not observable with electron microscopy. Matrix materials 104 and 106 in each layer are formed to have high thermal conductivity. Transition layer 108, which is very thin, is shown between layers 101 and 102. Field emission of electrons is believed to occur at the intersection of conductive channels 105 and surface 109 after substrate 103 is removed and when a suitable applied electric field exists at the surface.

Layers 101 and 102 are deposited in two steps that allow for the formation of more electrically conductive layer 101 followed by a less electrically conductive and higher thermally conductive layer 102. Transition layer 108, which is much thinner than layers 101 and 102, is formed as the gas composition is changed from the higher hydrocarbon content used in growing layer 101 to a lower hydrocarbon content used in growing layer 102. Transition layer 108, normally having a thickness of the order of tens of angstroms, is formed during the few seconds that gas composition changes in the plasma near the growing surface. Channels of higher electrical conductivity material 105 and 107 are believed to interconnect across transition layer 108. More electrically conductive layer 101 is not simply a nucleation layer as is commonly knowing in the prior art. Instead, the more electrically conductive layer provides the emitting surface for the device of this invention, which is surface 109.

Figure 1B:
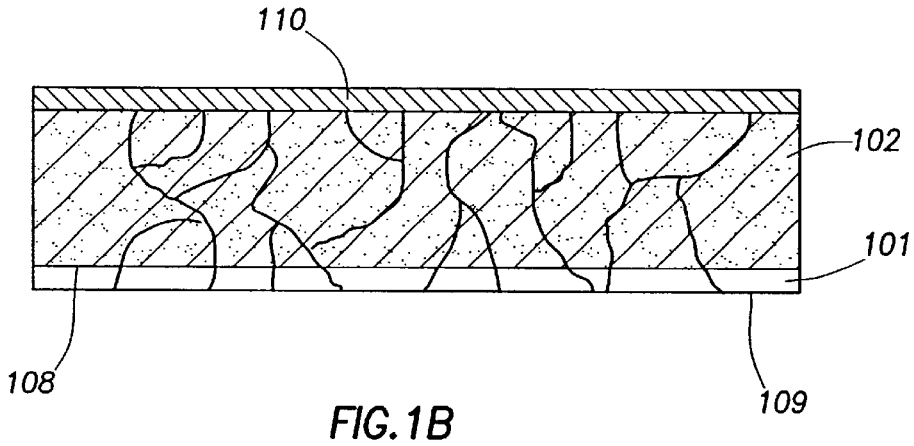

Substrate 103 is removed after the layers are grown and an electrode layer is deposited to form the electron emission device of this invention. The substrate can be removed by well-known physical or chemical methods. FIG. 1B depicts electrode 110 that has been placed on top of layer 102. Electrode 110 may be a layer of metal or other conductive material that is deposited to achieve ohmic contact with the surface of carbon-based layer 102.

The carbon-based material of this invention uses high carbon content deposition techniques that avoid the formation of completely $sp^3$ hybridized carbon, as would be the case with the formation of pure diamond films. The process does not use any special treatment of the carbon film designed to create microtips, fibers, whiskers, or any other structure containing a well organized arrangement of carbon atoms. Additionally, the process does not specifically create defects in a diamond and/or diamond-like carbon structure that have been shown in the prior art to yield carbon emitters. The process does include formation of a bulk solid material which is believed to result in creating conductive channels of carbon that randomly penetrate through the bulk of the carbon material.

Figure 2A:
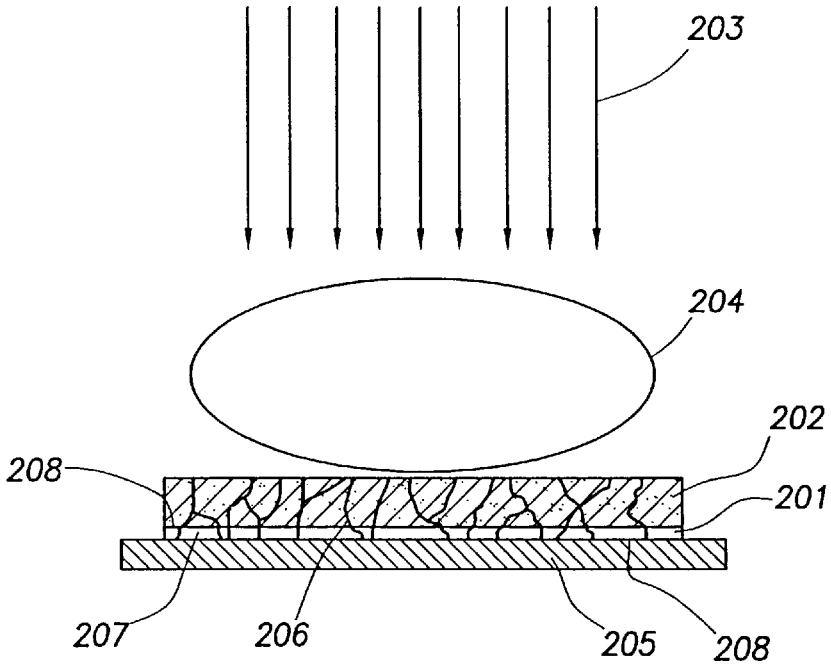
FIGS. 2A and 2B show schematic representations of a method for forming the high current carbon-based electron emitter of this invention on a flat substrate (A) or on a structured substrate (B).

FIG. 2A illustrates the process for forming the material of the present invention. In FIG. 2A, feedstock gas or combination of gases 203 containing a selected amount of carbon atoms is introduced into a vacuum chamber that is maintained in pressure between $10^{-5}$ Torr and 500 Torr. Preferably, the pressure is between 50 Torr and 200 Torr. The feedstock gas preferably contains, by volume, a combination of approximately 85–90% hydrogen, methane gas at a concentration greater than 5% methane up to about 13% methane, and the balance oxygen. To grow layer 201, the first layer, methane content is preferably greater than 8%, and most preferably methane content is greater than 10% by volume. Typical feedstock gas compositions used in the prior art for generating electron emissive carbon films call for a methane content below about 5%. Although methane is specified herein as the gas of choice for supplying carbon atoms to the system, it should be understood that any number of carbon-containing species may be used. Some of these carbon-containing precursors include, but are not limited to, ethane, propane, acetone, acetylene, methanol, ethanol and urea. The methane-equivalent amount of carbon atoms would be used for each precursor. If the carbon precursor is not a gas at room temperature, the precursor may be converted into a gas by standard techniques. The gas or gases 203 are then elevated in energy by means of a plasma, hot filament or laser to form gaseous species 204, in which resides carbon-containing ions and/or carbon atoms. The preferred gas activation method is a microwave or RF plasma operating at powers greater than 1 kW, but hot filament, laser or other techniques may be used to form a gaseous species in which resides carbon-containing ions and/or carbon atoms. High energy species 204 then impinge upon substrate 205, which is heated to a temperature in the range from about 250° C. to about 1200° C., preferably in the range from about 600° C. to about 1100° C. Substrate 205 should be chosen from any group of materials that are known carbide-formers, including Si, Mo, and Ti. Additionally, it has been found that a substrate growth surface pretreatment using diamond powder greatly enhances the growth of the carbon-based emitter material. A typical substrate pretreatment uses ultrasonic nucleation of the substrate in a suspension of diamond powder (less than 10 $\mu$m diameter particle size) in methanol for 20 minutes at 50 W power. After 20 minutes, the substrate is removed from the nucleating bath and cleaned of any residual diamond powder. This pretreatment and several other pretreatments for the growth of CVD diamond are known in the prior art.

The carbon-rich growth process results in higher electrical conductivity carbon-based layer 201 with electrically conductive carbon channels 206 penetrating through matrix material 207. Layer 201 is grown to a thickness of at least 0.5 micrometers, but preferably to a thickness greater than about 10 micrometers. Layer 201 should have an electric resistivity between $1\times10^{-1}$ and $1\times10^{-4}$ ohm-cm and preferably between $1\times10^{-2}$ and $1\times10^{-3}$ ohm-cm.

After layer 201 has been grown, the deposition conditions are changed to produce a less electrically conductive yet higher thermal conductivity layer 202. During growth of this layer, concentration of the carbon species in the growth reaction is decreased. The decrease may be brought about by several methods including decreasing the concentration of the carbon-containing feedstock gas, changing the growth temperature or decreasing the pressure in the reactor. Preferably, the concentration is decreased by reducing the carbon concentration in the feedstock gases to approximately 50 percent of the value used in growing layer 201. Layer 202 is then grown for a sufficient time to form a layer of selected thickness. Preferably, the thickness of layer 202 is at least ten-times as great as that of layer 201. The two layers are separated by transition layer 208 which is formed during the time hydrocarbon concentration is changing in the reactor. High thermal conductivity layer 202 has an electric resistivity between about $10^{-2}$ and $10^{3}$ ohm-cm and preferably between about $10^{-1}$ and 10 ohm-cm. Additionally, layer 202 has a thermal conductivity greater than 100 W/m-K. It is believed that it is this high thermal conductivity layer 202 that allows for high currents to be achieved with this material. In prior art devices, high current outputs lead to failure of the device due to high temperature caused by electron emission from small areas. In the present invention, high thermal conductivity layer 202 removes Joule heat from active layer 201 more readily, allowing high current densities. Carbon growth parameters used to grow the emitting layer 201 must avoid the typical growth parameters used to grow high-quality insulating diamond films, which employ gases poor in carbon content and rich in hydrogen content, and growth parameters used to grow heat removal layer 202 should provide adequate electric conductivity to allow electrons to flow through to emitting layer 201.

Substrate 205 is removed as described before and an electrode is applied as explained with reference to FIG. 1B. The thicknesses of the layers provide sufficient strength for the material to be handled as a body after the substrate material is removed. Because of the great thickness of the material, long growth times may be necessary. For example, at a growth rate of 10 micrometers/hour, growth times of more than one day may be necessary to grow a two-layer wafer or body of the carbon-based material. Substrates of large size may be used to form large wafers of the material of this invention, which can then have the substrate removed, have an electrode applied on the thicker surface and then be cut or sawed into the size of the emitter desired.

It was found that if the carbon-based material of layer 201 is primarily composed of either diamond and/or diamond-like carbon (containing 95–99% $sp^3$ carbon) then the present invention will have much greater electron emission properties, e.g., longer lifetime, greater emission stability, and higher current density at a given applied electric field. While not wishing to be bound to the present explanation, we believe that, if layer 201 is composed primarily of diamond and/or diamond-like carbon, the extremely high thermal conductivity of bulk material 207 conducts heat away from carbon channels 206 at a rate which allows the device to be operated at higher current densities and with greater stability over longer time periods than field emission materials of the prior art. Layer 202 serves to conduct heat away from layer 201.

Referring to FIG. 1B, field emission of electrons is found to occur from surface 109 when a suitable electric field is placed upon that surface. Typical threshold electric fields (fields that result in greater than 1 $\mu$A of emission current) are approximately 10 V/$\mu$m. A suitable ground contact must be made to the surface opposite the emission surface. Current densities greater than 100 A/cm$^2$ are achieved from the device of this invention at applied electric fields of less than 100 V/micrometer.

Figure 2B:
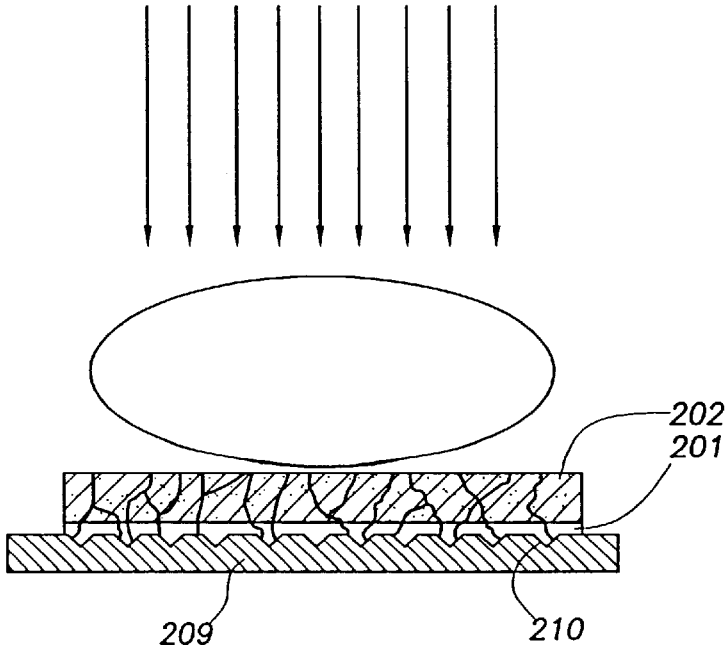

FIG. 2B shows the same process as FIG. 2A except substrate 209 has been structured before the growth process. The substrate may have a structure formed on its surface in a variety of ways. One method is by an anisotropic etch of silicon to form pits in the substrate. The pits then become protrusions in the carbon-based body of layer 201 after the substrate is removed. Other means for structuring the surface include abrasion with diamond dust, laser beams or ion bombardment on the substrate before growth of layer 201. The surface of a carbon-based body assumes the shape of the surface of substrate 209 after growth of the body. After removal of substrate 209, the textured surface of the carbon-based body maybe used to decrease the electric field requirements to achieve a selected level of current density during electron emission. The opposite surface of layer 202 is metallized as described in reference to FIG. 1B.

The material of this invention has use in a variety of applications that require high-power, high-frequency outputs and that will benefit from a cold cathode. The material of this invention is insensitive to effects of radiation and can operate over a temperature range of several hundred degrees Celsius. Some of the applications of this material are electron guns, RF and microwave amplifiers and microwave sources.

Figure 3A:
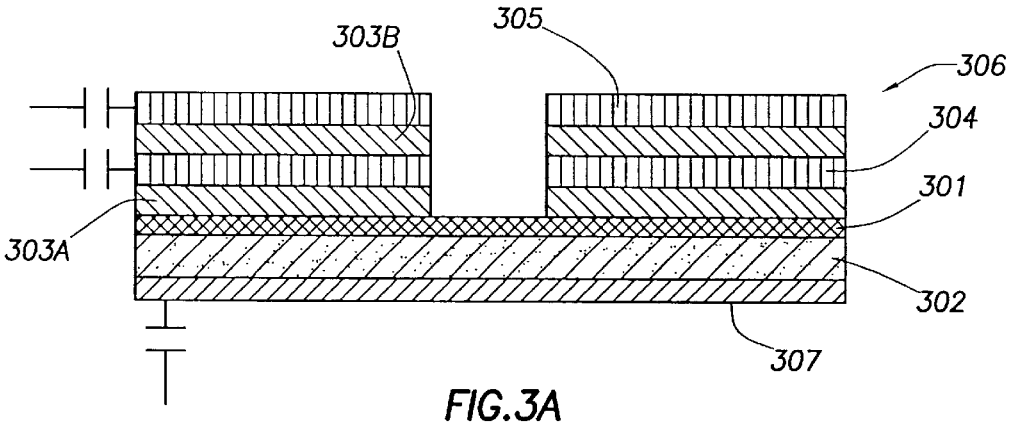
FIGS. 3A and 3B show schematic representations of an electron gun of this invention (A) and of a cathode ray tube including the electron gun (B).

Referring to FIG. 3A, the material of this invention is shown in electron gun 306. The emission layer 301 of the two-layer carbon-based electron emitter of this invention is sequentially covered by a first dielectric layer 303A, electron extraction electrode layer 304, second dielectric layer 303B and focusing electrode layer 305. Ohmic contact 307 is made to high thermal conductivity layer 302 to supply electrons to the electron gun. Suitable material for the dielectric layers is silicon dioxide or other insulating materials and a metal or other conductive material is suitable for the electrodes. Methods for fabricating the multiple dielectric and electrode layers and for creating the openings in the layers are those conventionally used in semiconductor fabrication art. It is preferable to create many electron guns on a single carbon wafer before sawing or otherwise dividing the multilayered wafer into separate electron guns. A typical electron gun will contain openings in the layers having a diameter between 1 and 5 micrometers and the openings will have a pitch (distance between centers of openings) in the range from about 10 micrometers to about 20 micrometers. Pitch can be as small only slightly greater than diameters, but calculations and results indicate pitch should be at least about twice the diameter of openings. For example, an electron gun may contain 1 micrometer openings with a 10 micrometer pitch in a 100×100 array of openings, or 10,000 openings. Still, thousands of electron guns can be produced on a single 2-inch diameter or larger carbon wafer.

Figure 3B:
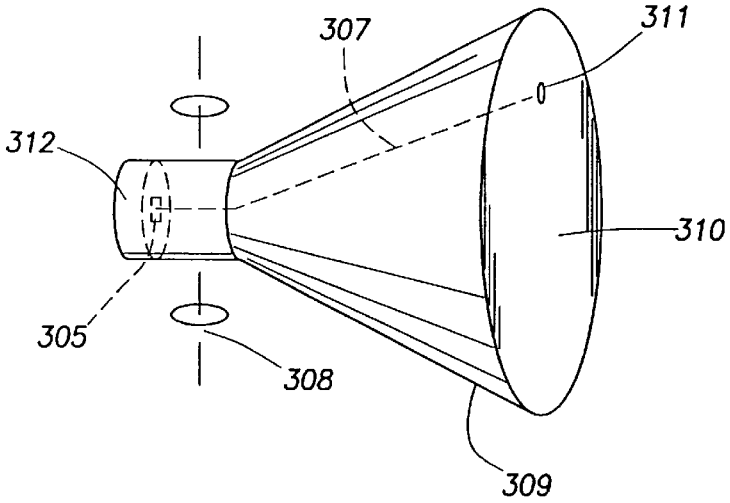

FIG. 3B shows the electron gun of FIG. 3A in a cathode ray tube (CRT). Referring to FIG. 3B, electron gun 305 is mounted onto electrical connection base 312 of the CRT. Electron gun 305 generates electron beam 307 when suitable power is applied to the device. The beam is steered by magnetic deflection coils 308 located outside CRT housing 309 and directed to strike phosphor screen 310 to produce image 311. The electron gun of this invention is particularly appealing because of the high output current density of the carbon-based emitter of this invention and the small size of the electron gun. The CRT may be such as those in television sets and computer monitors. Additionally, the electron gun can be used in many scientific instruments such as scanning electron microscopes and Auger electron spectrometers. Electron guns incorporating the material of this invention will have a higher brightness, smaller spot size and higher frequency of operation than electron guns of the prior art. This development makes possible brighter, higher resolution CRTs. As carbon-based cold cathodes emit electrons immediately when the proper electric field is applied, CRTs using them will turn-on instantaneously. Prior art CRTs using thermionic electron guns require a significant warm-up time if they are not constantly drawing electrical current through a filament or other thermionic electron emitter. Other advantages of using the carbon-based emitter of this invention in an electron gun are: longer life of the gun, greater stability of the electron beam and lower fabrication costs.

Figure 4:
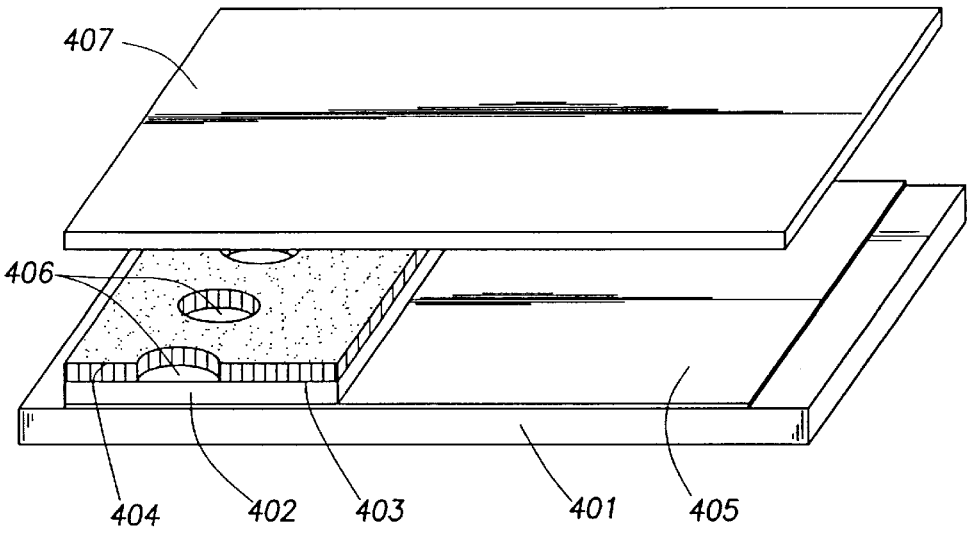
FIG. 4 shows a schematic representation of an amplifier of this invention.

The high current characteristic of the present material will also prove advantageous in RF and microwave amplifiers. Amplifiers will exhibit greater amplification power in smaller, lighter packages. A sketch of a high-frequency amplifier employing the material of the present invention is shown in FIG. 4. In this amplifier, insulating base 401 has conductive ground plane 405 composed of a metal or other conductive material deposited or attached to base 401. As a separate entity, a cold cathode emitter is formed by fabricating the carbon-based emitter 402 of the present invention, depositing dielectric layer 403 onto emitter 402, and finally depositing a conductive gate layer 404 upon the dielectric layer 403. Micrometer-sized holes 406 are subsequently opened in the gate layer and the dielectric layers using standard semiconductor fabrication techniques. The method of fabrication of this cold cathode is similar to that previously discussed for making an electron gun. The gated cold cathode 402/403/404/406 is attached to ground plane 405 by an electrically conductive adhesive such as conductive epoxy and anode 407 is placed at a selected distance apart from the base assembly to collect electrons. When the device is operational, a control signal is placed between ground plane 405 and cold cathode gate 404 and an amplified signal is generated between ground plane 405 and anode 407.

Figure 5:
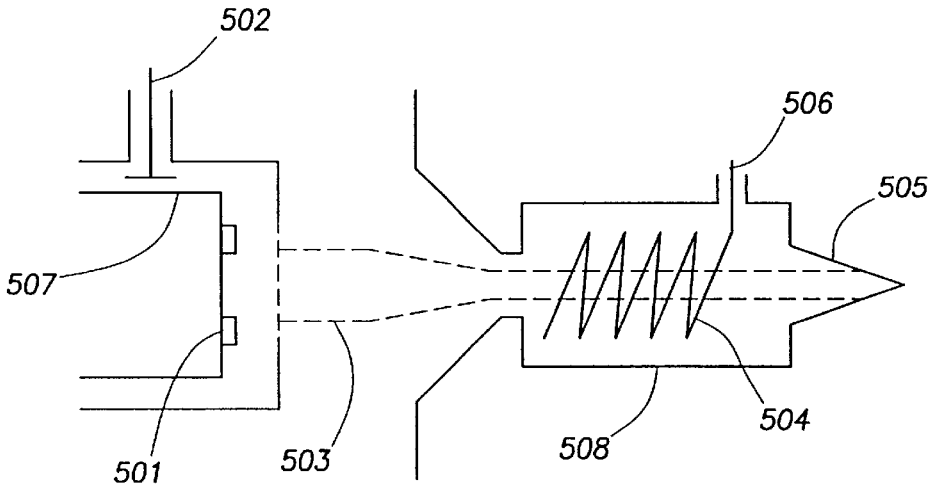
FIG. 5 shows a schematic representation of a traveling wave tube of this invention.

FIG. 5 shows a schematic of a traveling wave tube (TWT), a standard microwave generating device, incorporating the electron gun of the present invention. In this device, electrons are extracted from carbon-based emitter of this invention 501 by providing an RF excitation potential via input signal electrode 502 with respect to emitter base 507, which is DC-biased with respect to electrode 502. The emitted electrons are produced in pulsed beam 503 at the drive frequency of the signal input on electrode 502. Pulsed beam 503 is accelerated by high voltage and focused through helix 504 onto beam dump 505. Pulsed beam 503 inductively couples with helix 504, creating an amplified output signal (RF power) at output electrode 506. The device is enclosed in envelope 508. Advantages of TWTs using the present carbon-based electron source include superior efficiencies and higher power-to-weight ratios.

The carbon-based material of this invention is more particularly described by the following examples. The examples are intended as illustrative only and numerous variations and modifications will be apparent to those skilled in the art.

EXAMPLE 1

Referring again to FIG. 2A, silicon substrate 205 was pre-treated before carbon growth by immersion in a diamond powder and methanol suspension (0.1 g. 1 $\mu$m diamond powder in 100 ml. methanol) and subjected to ultrasonic vibration (50 W) for 20 minutes. Any residual diamond/methanol left on substrate 205 after sonification was removed by using a methanol rinse. Substrate 205 was then dried with dry nitrogen and introduced into a commercial microwave chemical vapor deposition system (ASTeX AX5400) on a water-cooled molybdenum holder. The reactor was evacuated to a pressure of less than 1 mTorr. Gas mixture 203, composed of 87% hydrogen, 11% methane, and 2% oxygen, was introduced into the reactor using gas flow rates of 532 sccm hydrogen, 70 sccm methane, and 9 sccm oxygen. The system was held at a constant pressure of 115 Torr. Microwave plasma 204 was ignited and maintained at 5 kW. Substrate 205 was raised into the plasma to maintain a deposition temperature between 900° C. and 1050° C. Carbon-based layer 201 was deposited onto substrate 205 for 2 hours at a deposition rate of 10 micrometers/hr, resulting in a material thickness of about 20 micrometers. The electrical resistivity of layer 201 was approximately 1×10–2 ohm-cm. At the end of the 2 hr growth period, the flow rate of methane was reduced to 40 sccm. This reduction in methane concentration caused a high thermal conductivity and more electrically resistive layer 202 to be directly and intimately deposited on emitting layer 201. Conductive carbon channels are believed to have grown through the structure. The high thermal conductivity layer 202 was deposited for 24 hours, resulting in a layer thickness of about 240 micrometers. After the growth cycle, substrate 205 was removed by chemical dissolution, exposing active surface 208. The entire freestanding carbon-based body had a measured thickness of 240 micrometers.

For device testing, electrode 110 as shown in FIG. 1B was installed and the device was placed into a test chamber under a vacuum of $5\times10^{-7}$ Torr. A separate electrode was brought into close proximity (approximately 20 micrometers) to the emitting surface to generate an electric field on the emitting surface. The emitting body produced greater than 30 micro amps of continuous direct current from a 4 sq micrometer area at an applied electric field of 54 V/micrometer. This is a current density of 750 A/cm$^2$. This is a much higher current density than reported in any known prior art.

For comparison to show the advantages of the high heat-conducting layer 202, the same process as that given above was followed except that emitting layer 201 was grown for 22 hours and no additional high thermal conductivity layer was added to the device. The film had a measured thickness of 165 micrometers. This film produced only 2.5 microamps current over a 4 sq micrometer area before it failed due to overheating at an applied electric field of 41 V/micrometer. This was a current density of 62.5 A/cm$^2$.

Although the present invention has been described with reference to specific details, it is not intended that such details should be regarded as limitations upon the scope of the invention, except as and to the extent that they are included in the accompanying claims.

What we claim is:

1. A traveling electromagnetic wave interaction device, comprising:

an electron field emission device comprising a carbon-based body having two layers, a second layer having a thickness greater than the thickness of a first layer, the layers being formed by placing a substrate in a reactor at a selected pressure and bringing the substrate to a selected range of temperature and supplying a mixture of gases comprising a carbon-containing gas at a first concentration to the reactor while supplying energy to the mixture of gases near the substrate for a time sufficient to grow the first layer and then reducing the concentration of the carbon-containing gas to a second lower concentration and growing the second layer and subsequently removing the substrate from the first layer, a dielectric layer deposited on the carbon-based body, the dielectric layer having openings therethrough, and an electron extraction electrode deposited on the dielectric layer, the extraction electrode having openings therethrough continuous with the openings through the dielectric layer;

electrical contacts to the carbon-based body and the electron extraction electrode;

an interaction region;

an input signal electrode for conducting an input signal into the interaction region;

an output signal electrode for conducting an output signal from the interaction region;

a collector for the electron beam; and an envelope for maintaining a vacuum and a selected spatial alignment.

2. The wave interaction device of claim 1 wherein the device is operated as a traveling wave amplifier tube.

3. The wave interaction device of claim 1 wherein the device is operated as an oscillator.

4. The wave interaction device of claim 1 wherein the device is operated as an electrical signal coupler.

5. The wave interaction device of claim 1 wherein the substrate is structured.

6. The wave interaction device of claim 1 wherein the first layer has a thickness greater than 0.5 micrometers.

7. The wave interaction device of claim 1 wherein the dielectric layer is silicon dioxide.

8. The wave interaction device of claim 1 wherein the diameter of the openings in the dielectric layer and the electron extraction electrode is in the range from 1 micrometer to 5 micrometers.

9. The wave interaction device of claim 1 wherein the spacing between openings in the dielectric layer and the electron extraction electrode is in the range from about 10 micrometers to about 20 micrometers.

10. The wave interaction device of claim 1 wherein the second layer has a thickness greater than about 10-times the thickness of the first layer.

11. The wave interaction device of claim 1 wherein the mixture of gases comprises methane or a hydrocarbon gas having carbon atoms equivalent to methane at a volume concentration between about 5 percent and about 13 percent methane.

12. The wave interaction device of claim 1 wherein the mixture of gases comprises methane or a hydrocarbon gas having carbon atoms equivalent to methane at a volume concentration between about 8 percent and about 12 percent methane.

13. The wave interaction device of claim 1 wherein the mixture of gases comprises methane or a hydrocarbon gas having carbon atoms equivalent to methane at a volume concentration greater than about 10 percent methane.

14. The wave interaction device of claim 1 wherein the mixture of gases further comprises oxygen.

15. The wave interaction device of claim 1 wherein the substrate is selected from materials consisting of carbide-forming materials.

16. The wave interaction device of claim 1 wherein the pressure in the reactor is in the range from about $1\times10^{-5}$ Torr to about 500 Torr.

17. The wave interaction device of claim 1 wherein the pressure in the reactor is in the range from about 50 Torr to about 200 Torr.

18. The wave interaction device of claim 1 wherein the temperature of the substrate is in the range from about 600° C. to about 1100° C.

19. The wave interaction device of claim 1 wherein the energy is supplied to the mixture of gases by the method of microwave or RF plasma.

20. The wave interaction device of claim 19 wherein the energy is supplied at a power level greater than 1 kilowatt.

21. The wave interaction device of claim 1 wherein the first layer has an electrical resistivity between about $1\times10^{-4}$ and $1\times10^{-1}$ ohm-cm.

22. The wave interaction device of claim 1 wherein the first layer has an electrical resistivity between about $1\times10^{-3}$ and $1\times10^{-2}$ ohm-cm.

23. The wave interaction device of claim 1 wherein the second layer has an electrical resistivity greater than the electrical resistivity of the first layer.

24. The wave interaction device of claim 1 wherein the current density from the device is greater than 10 A/cm$^2$ in the presence of applied electric fields less than 100 volts/micrometer.

* * * * *